United States Patent [19]

Izumi et al.

[11] Patent Number: 4,810,437

[45] Date of Patent: Mar. 7, 1989

[54] PROCESS FOR MANUFACTURING CARBON FIBER AND GRAPHITE FIBER

[75] Inventors: Takayuki Izumi, Iruma; Kikuji Komine, Tokorozawa; Wataru Kobayashi, Iruma, all of Japan

[73] Assignee: Toa Nenryo Kogyo K.K., Tokyo, Japan

[21] Appl. No.: 184,517

[22] Filed: Apr. 21, 1988

Related U.S. Application Data

[63] Continuation of Ser. No. 718,774, Mar. 29, 1985, abandoned.

[30] Foreign Application Priority Data

Jul. 29, 1983 [JP] Japan ..... 58-139199

[51] Int. Cl.[4] ..... D01F 9/12

[52] U.S. Cl. ..... 264/29.2; 264/29.1; 264/83; 264/211.11; 264/211.14; 264/211.17; 208/22; 208/37; 208/44; 423/447.4

[58] Field of Search ..... 264/29.1, 29.2, 211.11, 264/211.14, 211.17, 83; 423/447.4, 447.6; 208/22, 39, 44

[56] References Cited

U.S. PATENT DOCUMENTS

| | | | |
|---|---|---|---|
| 2,899,373 | 8/1959 | Steeves | 208/39 |
| 3,976,729 | 8/1976 | Lewis et al. | 264/29.7 |
| 4,005,183 | 1/1977 | Singer | 423/447.2 |
| 4,026,788 | 5/1977 | McHenry | 423/447.7 |
| 4,184,942 | 1/1980 | Angier et al. | 423/447.1 |
| 4,208,267 | 6/1980 | Diefendorf et al. | 423/447.1 |
| 4,209,500 | 6/1980 | Chwastiak | 423/447.2 |
| 4,219,404 | 8/1980 | Dickakian | 423/447.1 |
| 4,267,061 | 5/1981 | Simo et al. | 210/772 |
| 4,277,324 | 7/1981 | Greenwood | 423/447.4 |
| 4,303,631 | 12/1981 | Lewis et al. | 423/447.1 |
| 4,320,107 | 3/1982 | Oyabu et al. | 423/447.6 |
| 4,341,621 | 7/1982 | Fitzgerald | 208/45 |
| 4,436,615 | 3/1984 | Boodman et al. | 208/39 |
| 4,454,019 | 6/1984 | Izumi et al. | 423/447.4 |
| 4,460,454 | 7/1984 | Iijima et al. | 423/447.4 |
| 4,460,455 | 7/1984 | Moriya et al. | 423/447.4 |
| 4,465,586 | 8/1984 | Diefendorf et al. | 423/447.4 |
| 4,482,452 | 11/1984 | Shigeta et al. | 208/39 |
| 4,503,026 | 3/1985 | Dickakian | 423/447.4 |
| 4,511,625 | 4/1985 | Nazem et al. | 423/447.4 |
| 4,518,482 | 5/1985 | Dickakian | 423/447.4 |
| 4,528,087 | 7/1985 | Shibatani et al. | 423/447.4 |
| 4,533,461 | 8/1985 | Izumi et al. | 208/44 |
| 4,533,535 | 8/1985 | Uemura et al. | 423/447.4 |
| 4,534,850 | 8/1985 | Izumi et al. | 423/447.4 |
| 4,548,704 | 10/1985 | Dickakian | 423/447.4 |
| 4,589,974 | 5/1986 | Izumi | 208/22 |
| 4,601,813 | 7/1986 | Izumi et al. | 208/22 |
| 4,640,761 | 3/1987 | Mori et al. | 208/44 |

FOREIGN PATENT DOCUMENTS

| | | | |
|---|---|---|---|
| 44714 | 1/1982 | European Pat. Off. | 248/44 |
| 0084275 | 7/1983 | European Pat. Off. | 423/447.4 |
| 50118028 | 3/1977 | Japan . | |
| 102690 | 8/1980 | Japan . | |
| 5881619 | 11/1981 | Japan . | |
| 58-04823 | 1/1983 | Japan | 264/29.2 |
| 56140782 | 3/1983 | Japan . | |
| 56135296 | 3/1983 | Japan . | |
| 58-45277 | 3/1983 | Japan . | |
| 58-101191 | 6/1983 | Japan . | |
| 58-180585 | 10/1983 | Japan . | |
| 2125391 | 3/1984 | United Kingdom | 423/447.4 |

*Primary Examiner*—Jan H. Silbaugh
*Assistant Examiner*—Hubert C. Lorin
*Attorney, Agent, or Firm*—Seidel, Gonda, Lavorgna & Monaco

[57] ABSTRACT

A process for manufacturing a carbon fiber or graphite fiber includes melt-spinning a carbonaceous pitch, infusibilizing the resulting pitch fiber, carbonizing, and when necessary graphitizing the fiber. A precursor of the carbonaceous pitch is centrifuged in a molten state to separate the precursor pitch simultaneously into a solids slurry layer, an optically isotropic phase, and an optically anisotropic phase, and the latter is utilized as the carbonaceous pitch.

8 Claims, No Drawings

PROCESS FOR MANUFACTURING CARBON FIBER AND GRAPHITE FIBER

This is a continuation of application Ser. No. 718,774, filed on Mar. 29, 1985, now abandoned.

This invention relates to a process for preparing an optically anisotropic carbonaceous pitch suited for the manufacture of carbon products including lightweight, high-strength, and high-elastic-modulus carbonaceous fiber, graphite fiber, and other carbon articles, and also to a process for manufacturing carbon fiber and graphite fiber by melt spinning, carbonizing, and graphitizing the optically anisotropic carbonaceous pitch.

BACKGROUND ART

At the present time there is strong demand for high-performance engineering materials lighter, stronger, and more elastic than existing ones for use in various sectors of industry including automobile, aircraft, and other diversified fields. Attracting attention because of its potential to meet this demand is carbon fiber, a formed carbon material.

Optically anisotropic pitches, one group of starting materials for carbon fiber manufacture, are described, for example, in the specifications of (Japanese, unless otherwise specified) Patent Application Public Disclosure Nos. 19127/1974, 89635/1975, and 118028/1975. In these pitches, most of the optically anisotropic phase (hereinafter referred to as "AP") portion is equal to a quinoline-insoluble (or pyridine-insoluble) portion. If the AP portion of such a pitch were close to 100% the softening point would rise sharply, necessitating a spinning temperature of nearly 400° C. or even upward. Moreover, the spinning operation could induce generation of pitch decomposition gas and its polymerization. For this reason conventional spinning processes for the manufacture of carbon fiber limit the AP content to 90% or below, preferably in the range of 50 to 70%, and the spinning temperature to a level low enough to avoid appreciable thermal decomposition or polymerization.

Such a pitch composition of the prior art is a mixture of AP and a corresponding proportion of an optically isotropic phase (hereinafter referred to as "IP"), or a so-called heterogeneous pitch. The material therefore has shortcomings such as end breakages during spinning, ununiformity in fineness, or low strength of the resulting fiber.

Pat. App. Pub. Discl. No. 55625/1979 discloses a pitch material, homogeneous with 100% AP. The process for its preparation involves subjection of an isotropic pitch material to only a thermal reaction throughout, with careful control of thermal decomposition and polycondensation and uninterrupted agitation till attainment of homogeneity. After all, thorough thermal polymerization raises the softening point of the pitch material to about 300° C. or above, requiring the use of a high spinning temperature in the vicinity of 400° C., a level still too high for easy spinning operation on an industrial scale.

Other pitch materials have been introduced by the specifications of Pat. App. Pub. Discl. Nos. 160427/1979, 58287/1980, 130809/1980, 144087/1980, and 57881/1981. They are obtained by extracting an isotropic pitch or a pitch containing a very small proportion of AP with a solution, taking out the portion most of which forms AP and which has a low quinoline-insoluble content, and then melting that portion. It is true that a material with a specifically low quinoline-insoluble content of 25% or downward can be prepared by such a process. However, as will be readily appreciated by one skilled in the art from the process and pertinent data revealed, the product has such a high softening point that a high spinning temperature on the order of 400° C. must be used, rendering it still difficult to carry out the spinning in a stable way industrially.

As stated above, the known homogeneous, optically anisotropic pitches with nearly 100% AP have so high softening points that they are difficult to spin stably. Low-softening-point pitches of the prior art, excepting those of unusual compositions and structures produced from special starting materials, are also difficult to spin because of the heterogeneity. Thus, obtaining a carbon fiber of excellent quality has been next to impossible.

As regards the conventional methods of defining the properties of pitch compositions, it is common practice to define an optically anisotropic pitch by its partial chemical structure, average molecular weight, or quinoline-insoluble (or pyridine-insoluble) content. These methods have, of course, been inappropriate because they cannot specify an optically anisotropic pitch composition with homogeneity and low softening point suitable for the manufacture of high-performance carbon fiber or other carbon products. This is explained from the fact that the composition known as optically anisotropic pitch is actually a mixture of very diverse, complex compounds with broad ranges of chemical structures and molecular weights, for example, from hundreds to tens of thousands, and in some cases short of the molecular weight of coke; the composition therefore cannot be simply defined by the characteristic chemical structure of a certain part or the whole on the average.

The present inventors have intensively studied on the optically anisotropic pitch composition suited for the manufacture of high-performance carbon fiber. As a result, it has already been found that the optically anisotropic pitch, a pitch with good molecular orientation having a developed structure of condensed polycyclic aromatics, actually contains various compounds, of which those having low softening points and suited for the carbon fiber manufacture have certain specific chemical structures and compositions. In other words, factors of great importance to an optically anisotropic pitch are the compositions, structures, and molecular weights of the n-heptane-soluble matter and the n-heptane-insoluble but benzene-soluble matter the particular pitch contains. The finding led to the filing of Pat. App. No. 162972/1980.

Continued research has been centered on the mixing ratio of AP and IP and the microscopic form of pitch. The research has revealed that, although a completely-single-phase pitch of substantially 100% AP having a softening point in the range of 250° to 300° C. can be made, the allowances for the conditions of producing such a pitch are rather limited and it is not always easy to produce industrially a stable pitch having a steady, sufficiently low softening point despite changes in material and which permits the use of the same proper spinning temperature.

On the other hand, a pitch containing the IP portion to excess, say 30% or upward, generally may have a satisfactorily low softening point. It has, however, been confirmed that the pitch during spinning behaves apparently as a mixed phase of two liquids differing in viscosity, exhibiting poor spinnability and hence yielding a carbon fiber of inadequate properties.

With the progress of research, a pitch has been unveiled which has an IP content of not more than about 20%, desirably not more than about 10%, most of the IP dispersed in the AP matrix being spheres having a diameter of about 100 μm, preferably about 50 μm or less, or more preferably in the form of microspheres having a diameter of about 20 μm or less, and has a sufficiently low softening point. With good spinnability the pitch is an optimum precursor material for the manufacture of carbon fiber with adequate performance. As an additional advantage it has been found possible to produce the pitch stably with substantially unchanged properties in commercial operation. The findings materialized in Pat. App. No. 140782/1981.

The optically anisotropic pitch with the foregoing advantages is manufactured in a number of ways. Typically a carbonaceous pitch which partly contains AP in a molten state is held in a static condition at 350° to 400° C. where the thermal decomposition-polycondensation reaction does not proceed noticeably and most of AP easily settles down by gravity for unity, collecting the AP portion downward out of the pitch, and then separating and taking out the AP-rich lower layer from the overlying layer low in AP, as proposed by the present inventors. Patent Applications covering the method have been filed as Pat. App. Nos. 99646/1980, 162972/1980, 11124/1981, 135296/1981, and 140782/1981.

Thereafter, the present inventors have continued their search for a process whereby such an optically anisotropic pitch having desirable spinning properties, low softening point, and a high AP content would be produced in a more stable and economical manner. The research has led to the findings as below.

It has been found possible to produce an improved, excellent optically anisotropic pitch by the following method. A carbonaceous pitch partially containing AP is centrifuged in a molten state, so that the AP portion of heavier specific gravity is quickly settled and coalesced centrifugally, and the AP-rich half of the material is separated and taken out from the remainder of lighter specific gravity that consists mostly of IP.

Thus, in the field of centrifugal force exerted artificially the AP settling from the material pitch takes place far faster than in a static field of gravity provided the temperature is the same. Not only the AP settling but also the formation of a single phase due to the coalescence that follows the settling can be accelerated by the centrifugal action. It has further been found that, by freely controlling the centrifugal acceleration to be applied, or the rotational speed of the centrifugal operation, it is possible to produce an optically anisotropic pitch of a low softening point at an eventually adequate AP concentration and with good reproducibility, within a far shorter period of time, using the lower treating temperature, than by the gravitational settling or other prior art methods.

The newly found method has, however, a very high possibility of causing difficulties when fine solid particles are present in the carbonaceous pitch. First, the solids can invite end breakages and yarn unevenness during spinning. Second, they can find way into the resulting carbon fiber, causing a major structural defect or sharply reducing the tensile strength and breaking elongation of the fiber.

The expression "fine solid particles" as used herein means those originally contained in the raw material, for example, catalytic- or steam-cracking residue, liquefied coal, and the like; small to trace amounts of residual catalyst, rust, dirt, ashed granules, inorganic matter, and the substance detected as ash content; and carbonaceous solids or coky particles contained in the material; and those secondarily formed during pitch making or deposits falling off from the walls of the reaction vessel or piping. The mass of such fine solid particles (solid slurry) is observed on melt filtration or centrifuging as a quinoline-insoluble or high-C/H-ratio portion.

DISCLOSURE OF THE INVENTION

The present inventors have undertaken extensive research on a method of solving the foregoing problems. They have now found, as a result, that a high-performance carbon fiber can be manufactured by centrifuging a precursor of carbonaceous pitch in a molten state, thereby separating the precursor pitch into a solid slurry layer and AP, and then employing the resulting AP as the carbonaceous pitch (material) for the fiber manufacture. The present invention has been perfected on this basis.

A principal object of the invention is to provide a process for producing an optically anisotropic carbonaceous pitch having a high AP content and a low softening point suited for the manufacture of a high-strength, high-modulus carbon article, especially carbon fiber.

Another object of the invention is to provide a process for producing an optically anisotropic carbonaceous pitch suited for the manufacture of a high-strength, high-modulus carbon article, especially carbon fiber, which is sufficiently highly oriented and homogeneous to preclude end breakage or yarn unevenness on spinning.

Still another object of the invention is to provide a process for producing a highly spinnable, optically anisotropic carbonaceous pitch capable of being spun at a temperature sufficiently below the level at which thermal decomposition and polycondensation take place actively, for the manufacture of high-strength, high-modulus carbon fiber.

Yet another object of the invention is to provide a process for producing efficiently, economically, and stably an optically anisotropic carbonaceous pitch suited for the manufacture of high-strength, high-modulus carbon fiber.

A further object of the invention is to provide a process for manfacturing high-strength, high-modulus carbon fiber and graphite fiber from an optically anisotropic carbonaceous pitch having a low softening point, homogeneity, and excellent molecular orientation and capable of being melt spun stably at an adequately low temperature.

As stated above, the present invention covers a process for producing a pitch material having a high AP content and yet a low softening point. The process is characterized by centrifuging of a pitch in a stage where it partly or wholly contains AP and therefore the remainder consists of IP (that is, a precursor pitch) in a molten state and at a temperature such that thermal decomposition and polycondensation do not proceed appreciably and a sufficient viscosity is produced to facilitate the centrifugal settling and coalescence of most of the AP, thereby centrifugally settling and coalescing most of AP in the pitch, and separating and taking out the portion at the high AP concentration from that of the lower concentration, while at the same time separating a solid slurry layer (the portion of heavier specific gravity with a larger solid particle content).

The solid slurry layer is generally a solid phase in the form of fine solid particles deposited on the inner walls of the rotating cylinder of a centrifuge. The deposits of fine solids are removed from the inner walls by suitable means, for example, a scraper. By forming a solid phase and removing fine solid particles in this way an AP of good quality can be obtained.

Thus, in one embodiment of the invention, a precursor pitch consisting almostly solely of AP is separated into AP and a solid slurry. In another embodiment the precursor pitch is simultaneously divided into three layers, that is, IP, AP, and solid slurry layers.

For use in the manufacturing process of the invention the intermediate carbonaceous pitch (precursor pitch), or a pitch substantially free of IP by a suitable pretreatment or a pitch partly containing AP, can be produced by the usual method involving a thermal "heavying" reaction. As the feedstock, a heavy hydrocarbon oil, known as tar, for example, a catalytic cracking residue, thermal-(or steam-)cracking tar, commercially available pitch or the like is employed. The material is allowed to react thermally using a temperature of about 380° C. to about 460° C. for a necessary period of time. The reaction product is freed of the volatile matter at a lower temperature in the range of 300° C. to 380° C. (by stripping with an inert gas or vacuum distillation). Alternatively, the feedstock is thermally reacted while being freed from the volatilizables at about 380° C. to 460° C. In either way a pitch can be produced which partly contains AP and exhibits a sufficiently low softening point as a starting material for the process of the invention.

A preferred process for the production of the intermediate carbonaceous pitch is as follows. A thermal reaction is effected under the foregoing conditions, using as the starting material a tarry material which contains as at least the main component a component having a boiling point of 540° C. or upward as described in the specification of Pat. App. No. 135296/1981 which is a compound consisting mainly of carbon and hydrogen, containing aromatic oil and resin components as n-heptane-soluble components and mainly asphaltene as an n-heptane-insoluble component, having aromatic carbon fractions, fa, of the aromatic oil and resin components of not less than 0.7 each, a number-average molecular weight of 1,000 or downward, and a maximum molecular weight of not more than 2,000. A more preferred material is one having an aromatic carbon fraction, fa, of asphaltene or more than 0.7, a number-average molecular weight of less than 1,500, and a maximum molecular weight of less than 4,000. By the aromatic carbon fraction, fa, is meant the ratio of the carbon atom amount in aromatic structures determined by the infrared absorption method to the total carbon amount. By the maximum molecular weight is meant the molecular weight determined by gel permeation chromatography at the point of 99 wt% addition to the low molecular weight side. The number-average molecular weight is determined by the vapor pressure equilibrium method. A desirable example of such a starting material is the residue from the catalytic cracking equipment.

In the process described above, the pitch low in AP, left after the separation of the AP-rich pitch on centrifuging, may be recycled to the thermal cracking-polycondensation and volatilizable-removal steps for adjustments to appropriate AP concentration, composition, and softening point and then be centrifuged again. Thus, in accordance with the invention, the thermal cracking-polycondensation and centrifuging may be repeated in this manner to obtain a high-grade optically anisotropic pitch in a high yield.

The pitch at a high AP concentration obtained after the centrifuging may be after-treated lightly by a thermal reaction for heavier structure or by a solvent treatment to adjust the pitch properties, so that a high-grade optically anisotropic pitch with a quality well within a desired narrow control range can be obtained.

Further, a fiber of a stable quality with high strength and elastic modulus and improved breaking elongation can be obtained by spinning the optically anisotropic pitch having a high AP content and low softening point prepared by the treatments of the invention including centrifuging, rendering the spun pitch thermosetting by oxidation, and the carbonizing or graphitizing it.

The terms and measuring and analytical methods used for the purposes of the invention will now be explained.

The expression "optically anisotropic phase (AP)" of the pitch as used herein represents a form of the pitch constituent. When the cross section of a split mass of pitch solidified at about the ordinary temperature is polished and observed under a reflection polarizing microscope with a Nicol prism, brightness may be seen when either the test specimen or the prism is rotated. When such is the case, the pitch portion is optically anisotropic. The pitch portion where no brightness is seen, or the optically isotropic portion, is called an optically isotropic phase (IP).

Between AP and IP a clear boundary is observed. (Usually, dirt, bubbles, and other impurities which are neither AP nor IP can be distinctly distinguishable.) AP may be considered the same as the so-called "mesophase". The mesophase has two types, one contains more substances substantially insoluble in quinoline or pyridine than the other which has a larger content of substances soluble in quinoline or pyridine. The term AP for the purposes of the invention refers largely to the latter type of mesophase.

As compared with IP, AP apparently consists mainly of the molecules of the chemical structure with more developed flatness of polycyclic aromatic condensed rings. Presumably the molecules are aggregated and associated in the form of a laminate of planes and is in a state of liquid crystal at the melting temperature. When the melt is forced through minute nozzle holes for spinning, the molecular planes are arranged nearly parallel to the filament axes, and therefore the carbon fiber produced from this optically anisotropic pitch exhibits high elastic modulus.

AP or IP is estimated by observation or photographing under a polarizing microscope with a Nicol prism and by determination of the rate of area the AP or IP portion occupies. Statistically, the area rate represents, in essence, the percentage by volume.

However, since the difference in specific gravity between AP and IP is only about 0.05, the percentage by volume and that by weight in the above estimation may be considered approximately the same. While the conditions of AP and IP in a molten state at elevated temperatures apparently differ from those at room temperature, the conditions are all specified herein as observed at room temperature.

Herein referred to as an optically anisotropic pitch is a pitch most of which is accounted for by AP in which IP is encompassed in the form of spheres or indefinite islands. Thus, what is called an optically anisotropic pitch in the present invention is not always one consisting substantially of 100% AP. The AP content is calculated by deducting it from the IP content measured as 100%.

With regard to the homogeneity, a pitch having a sufficiently low measured IP content, substantially no detectable solid particle (one micron or larger in diameter) in the pitch section observed under a reflection microscope, and practically no foam due to volatile matter at the temperature for melt spinning exhibits desirable homogeneity for actual melt spinning. For the purposes of the invention, such a pitch is generally called a "substantially homogeneous optically anisotropic pitch."

More specifically, a pitch with an IP content of about 20% or below is referred to as a substantially homogeneous optically anisotropic pitch.

In case of the pitch containing more than 20% IP or containing 20% or less but relatively large-size IP dispersed in AP, the material is actually a mixture of two distinct phases of highly viscous AP and less viscous IP. Spinning the mixture of pitch components widely differing in viscosity results in frequent and breakage, difficulty in high-speed spinning operation, and inability to produce satisfactorily thin filaments. The filament size is uneven, too. Consequently, high-performance carbon fiber cannot be obtained. If the pitch to be melt spun contains infusible fine solid particles or low-molecular-weight volatile matter, the spinnability is impaired and the resulting pitch fiber contains bubbles or solid impurities as is obvious to one skilled in the art.

For the purposes of the invention, the term "softening point of pitch" is used to denote the solid-liquid transition temperature of a pitch. This is determined from the latent-heat absorption and release peaks on melting or solidification of the pitch measured by means of a differential scanning calorimeter. This temperature agrees with those determined with other methods, such as ring-and-ball and micro-melting point methods, within a tolerance of ±10° C.

By a "low softening point" is meant herein a softening point in the range of 230° to 320° C. The softening point is closely related to the melt spinning temperature of the pitch. Here the term spinning temperature means the optimum temperature at which the pitch to be spun is kept in a molten state inside the spinning equipment and, where there is temperature distribution, the highest temperature. It is not necessarily the temperature at the spinneret holes but usually is the temperature in the vicinity of the deaeration region inside the extruder. When pitch is to be spun in the usual manner, a temperature higher than its softening point by 60° to 100° C. is generally the temperature that makes the material viscous enough for spinning, although the temperature depends more or less on the kind of pitch. With a pitch having a softening point above 320° C., it is likely that the spinning temperature exceeds 380° C. at which thermal decomposition and polycondensation take place. Such a high temperature would produce decomposition gases and infusible matter that impair the spinnability of the pitch, and bubbles and solid impurities in the resulting pitch fiber could make the product defective. A pitch having a softening point below 230° C., on the other hand, requires complex and expensive treatments, including a low-temperature, long-period treatment for the infusibilizing process. In either case the results are unsatisfactory.

In the practice of the invention, the n-heptane-soluble, heptane-insoluble, benzene-insoluble, and quinoline-insoluble contents as pitch constituents are determined as follows. Powdered pitch is placed in a cylindrical filter having minute holes with an average diameter of one micron. Using a Soxhlet apparatus, extraction of the pitch with n-heptane is carried out for 20 hours with the application of heat. The dissolved amount is determined as the n-heptane-soluble content, and the insoluble residue as the n-heptane-insoluble content. The latter is then subjected to hot extraction with benzene for 20 hours, and the insoluble residue is determined as the benzene-insoluble content.

Meanwhile, the powdered pitch is centrifuged with quinoline as a solvent, in conformity with the procedure of JIS-K-2425, and the insoluble content is determined as the quinoline-insoluble matter. The ingredient insoluble in benzene but soluble in quinoline is obtained by deducting the quinoline-insoluble content from the benzene-insoluble content as determined above.

Fractional determination of the constituents may be performed, for example, by the method described in the Journal of the Japan Petroleum Institute, Vol. 20, No. 1 (1977), p. 45.

BEST MODES OF CARRYING OUT THE INVENTION

The present invention will now be described in more detail. Heretofore, a method of increasing the AP proportion in a pitch has been known which involves through thermal cracking and polycondensation of a heavy hydrocarbon oil, tar, commercially available pitch or the like as general material for the production of pitch, in a reaction vessel at 380° to 500° C., with agitation and removal of volatilizables with an inert gas. Generally, when the AP exceeds 80% in accordance with the method, although it depends on the raw material or temperature used, the thermal cracking-polycondensation reaction will proceed to excess with a large quinoline-insoluble content of more than 70% by weight. IP will hardly be dispersed in the form of microspheres, and the softening point of the resulting pitch will be over 300° C., in many cases over 330° C.

In view of this, the present inventors previously contrived a process for preparing an optically anisotropic pitch with a high AP concentration. The process comprised discontinuing the thermal cracking and polycondensation midway, holding the polycondensate and allowing it to stand at a temperature within the range of 350° to 400° C., thereby allowing a layer of high density AP to grow, age, and settle below, and then taking this away from the overlying lower-density, IP-rich layer. Patent application No. 99646/1980 was filed therefor. The present invention is concerned with a novel process which is a further refinement of the above process.

According to this invention, a carbonaceous pitch having a proper AP content and not made excessively heavy is centrifuged in a molten state. Then the AP portion, which has a heavier specific gravity than the IP portion, rapidly settles down and gathers while coalescing and growing to form a lower layer (in the centrifugal direction). The lower layer thus is a pitch consisting of about 80% or more AP in the form of a continuous phase in which IP is embraced as islands or microspheres. The upper layer is a pitch most of which is IP, with AP being dispersed therein as microspheres. Next, the lower layer is separated from the upper layer and is recovered by taking the advantage of their distinctly distinguishable boundary and considerable differences in viscosity and other properties between the two layers in the molten state. In this manner an optically anisotropic carbonaceous pitch having a low softening point an a high AP content is obtained.

The material pitch to be centrifuged is one having a softening point preferably below 280° C. and an AP content of about 20 to about 70%, with most or practically all of the AP contained in the form of spheres not larger than 500 μm, preferably not larger than 300 μm, in diameter. Also, the material pitch is desired to have a viscosity of 100 poises or under, preferably 50 poises or under, at a temperature in the range of 280° to 400° C. The temperature for the separation of fine solid particles is desired to be as high as possible above the softening point of the pitch. Over 400° C., however, a thermal polymerization reaction of the pitch takes place, and equipment problems arise, including damages due to elevated temperatures. Therefore, the use of the above temperature range and a pitch with a viscosity of not more than 100 poises renders it possible to separate the fine solid particles effectively. The process of the invention for pitch preparation thus comprises adjusting material pitch to possess the afore-described properties, keeping it in a molten state, centrifuging the pitch under conditions such that AP spheres readily settle downward while being coalesced in the field of centrifugal force and the thermal cracking-polycondensation reaction of the pitch ingredients does not proceed appreciably, that is, at a temperature above the softening point of the intermediate carbonaceous pitch, preferably in the range of 280° to 400° C., more preferably in the range of 320° to 380° C, for a sufficient and necessary period of time for the temperature and the centrifugal acceleration exerted, thereby collecting a high density AP as a continuous phase in a lower layer, separating and taking out the lower layer away from the overlying layer of less density and larger IP content, and separating and removing fine solid particles 1 to 10 μm or larger in diameter as a solid slurry layer.

Centrifuging is a treating process whereby a fluid is rotated at a high speed so that a phase of a heavier specific gravity is collected out of the fluid into a lower layer (as viewed in the centrifugal direction) for separation. In one embodiment the operation with what is known as a centrifuge, especially of a continuous type, liquid cyclone or the like which separates the heavy and light phases in uninterrupted operation, is advisable.

In obtaining an optically anisotropic pitch of the invention, therefore, a material pitch having an AP content of about 20 to about 70%, preferably about 30 to about 50%, is centrifuged. As for the preferred form of AP in this stage, it is desirable to centrifuge a material pitch in which AP is dispersed in the form of true spheres 500 μm or smaller in diameter and not in an advanced stage of coalescence yet, preferably in the form of true spheres 300 μm or smaller in diameter.

Also, under the invention, the pitch composition before being centrifuged is desired to contain 30% or less by weight of the quinoline-insoluble matter and 25 % or more by weight of the benzene-insoluble but quinoline-soluble matter.

To be more specific, difficulties will be involved if the pitch to be centrifuged contains more than 30% by weight quinoline-insoluble matter or less than 25% by weight benzene-insoluble-quinoline-soluble matter. Usually, with such a composition, large spheres or lumps of IP tend to remain in AP. To avoid this a very high temperature, great centrifugal force, or long retention time is necessary, making the process uneconomical. Moreover, the quinoline-insoluble matter in the separated optically anisotropic pitch tends to be concentrated to as high as 70% by weight or more. The softening point is accordingly raised to affect the spinnability adversely, rendering it difficult to obtain a carbon product of satisfactory performance.

Now, desirable conditions for the centrifuging process will be explained. The temperature to be used depends on the magnitude of centrifugal force, but is usually above the softening point of the intermediate carbonaceous pitch, preferably in the range of 280° to 400° C., preferably in the range of 320° to 380° C. The temperature may or may not be constant within such a range. The temperature is also desirably chosen so that the viscosity of the pitch is 100 poises or under, preferably 50 poises or under. A pitch viscosity of higher than 100 poises makes the separation and removal of fine solid particles extremely difficult; the particles remain embraced by AP and fail to form a slurry layer.

In this process step, which aims primarily at settling and coalescing most of the AP in the centrifugal direction, it is necessary to avert thermal decomposition and polycondensation reaction wherever possible. For this reason a temperature above 400° C. is undesirable, and the temperature higher than necessary hampers continuous long-period operation of the centrifuge. No such problem arises from the use of a temperature within the range specified above. If the temperature is below the specified range, the total pitch system, especially its AP portion, is so viscous that the IP coprecipitated in the AP in the lower layer is difficult to separate, even by centrifuging for an extended period of time with a very high degree of acceleration.

The temperature to be used for the centrifugal separation, magnitude of the centrifugal force, and retention time are closely related to the softening point of the particular pitch. In order that a temperature in the specified range may be employed, it is desirable that the softening point of the pitch to be centrifuged be not higher than 280° C. If the softening point is above this range, the melt viscosity of the pitch, especially of the AP portion, is so high that an unusually long retention time or excessive centrifugal force is necessary to achieve thorough centrifugal separation of the AP.

Centrifuging that characterizes the present invention may use a centrifugal acceleration of at least 10,000 G, especially in the range of 10,000 to 40,000 G, with the view to effectively removing fine solid particles from the pitch. In this way solid particles as fine as 10 μm or less in size can be advantageously separated. Existing equipment limits the centrifugal acceleration to not greater than 50,000 G.

In any case, in conformity with the process of the invention, a carbonaceous pitch having a proper AP content is centrifuged in the manner described above for concentration and separation. Thus, an optically anisotropic pitch having an AP content of 80% or upward is easily prepared. In particular, such a product having an AP content of as much as 95% or more can be obtained economically within a short period of time, with a softening point appropriately low, in the range of 230° to 320° C.

The process of preparing an optically anisotropic pitch which combines such a high AP concentration with a low softening point within a short period and with ease is unparalleled in the art and constitutes a major advantage of the invention.

The optically anisotropic pitch with the high AP content, especially of more than 95%, and the low softening point within the range of 230° to 320° C. exhibits excellent adaptability for melt spinning. The homogeneity and high degree of molecular orientation enable the pitch to yield carbon and graphite fibers with outstanding tensile strength and modulus of elasticity.

The improved process of the invention for the production of pitch is characterized, as described above, by the steps of centrifuging an intermediate carbonaceous pitch containing an adequate proportion of AP and not completely thermally decomposed or polycondensed, and extracting the AP in a condensed form.

There is no special limitation under the invention to the preparation of the intermediate carbonaceous pitch having a proper AP content for use in the present process; pitches made by whatever methods may be employed. The pitch is conveniently produced prepared in the following way.

The heavy hydrocarbon oil tar or pitch secondarily produced by the petroleum or coal industry is employed as the starting material. It has a large aromatic carbon content and also contains many hydrocarbons having a boiling temperature above 400° C. Particularly a heavy oil tar as a by-product from the catalytic cracking of petroleum, with impurities such as minute catalyst particles decreased to 0.01% by weight or less by filtration, centrifuging, or other means, is suitable. The starting material is allowed to react thermally, principally for thermal cracking and polycondensation at a temperature ranging from about 380° to about 460° C., preferably from 400° to 430° C., and at ordinary pressure, while promoting the removal of volatile matter from the decomposition products with the passage of an inert gas. The reaction is discontinued at the point when the pitch with properties modified to the ranges suited for centrifuging has resulted, and the pitch is transferred to the centrifuging station. The timing for discontinuing the reaction may be empirically determined beforehand from the combination of the properties of the starting material, the flow rate of the inert gas, and the reaction temperature. The inert-gas flow rate cannot be specified because it is dictated by the configurations of the reaction vessel and the quantity of the matter retained in the liquid phase. Generally, however, an objective pitch can hardly be obtained unless the inert gas is flowed at a rate of more than one liter per minute per kilogram of the liquid-phase retained matter. Also, in this case the gas may be either flowed over the liquid phase surface or bubbled through the liquid phase. In an alternative process, it is possible to eliminate the passage of inert gas when carrying out the thermal reaction principally aimed at thermal cracking and polycondensation of the same starting material as used above, at about 380° to about 460° C., preferably at 400° to 430° C. Instead, the reaction is effected either at ordinary pressure with much reflux or under pressure of 2 to 200 kg/cm$^2$. Removal by evaporation of decomposition products and other low-molecular matter may also be undertaken, following the thermal reaction mainly intended for the thermal cracking and polycondensation, by distillation under reduced pressure or by stripping distillation with passage of an inert gas, at about 300° to about 380° C., preferably at 330° to 370° C. In this alternative process, too, a pitch with properties in ranges suited for centrifuging can be prepared by empirically choosing appropriate temperature and time for the thermal cracking and polycondensation and also proper temperature and time for the distillation for removal of volatilizables, depending on the properties of the starting material.

The inert gas referred to in the foregoing description is any of the gases that will not react materially with the pitch material at around 400° C. For example, $N_2$, Ar, steam, and low-molecular-weight hydrocarbons are practically useful. Such a gas may, of course, be reused by recycling.

In the process of the invention for pitch production, the upper-layer pitch secondarily produced by centrifuging, or the pitch consisting mostly of IP, is not discarded. It can be suitably treated for a thermal cracking-polycondensation reaction again but to a lesser degree this time and then for another cycle of centrifuging. This repetition of process steps improves the final yield of the objective pitch. The treatment for this purpose may, for example, be a heat treatment at 350° to 600° C. or solvent extraction for the removal of low-molecular-weight pitch ingredients.

As another modification of the present process, a suitable finishing step may be added as an after treatment that follows the centrifuging. The modified process uses a particularly short retention time for the centrifuging stage to prepare an optically anisotropic pitch with a rather insufficient AP content of about 80 to 90% and then treats the pitch for a thermal reaction for "heavying" or gravity increase at 300° to 430° C. for qualitative adjustments so that the end pitch product comes within narrow controlled limits of properties.

A carbonaceous pitch having an AP content of 80 to 90% contains 10 to 20% IP, and it has been found that this IP portion can be further decreased by a slight thermal reaction for gravity increase, with attendant gradual increase in the softening point. Therefore, the AP content can be adjusted to 95% or more and the softening point to the range of 280° to 300° C. by increasing the specific gravity of the centrifuged pitch through treatment using suitably controlled temperature and time. In this way the conditions for subsequent steps, that is, for melt spinning, infusibilizing, and carbonization, can be substantially constantly controlled and the quality of the product carbon fiber can be stabilized.

For this finishing after treatment, it is, of course, possible to use solvent extraction, washing with a solvent, or other techniques besides the thermal reaction for increase in specific gravity.

Next, the process for manufacturing a carbon filter and a so-called graphite fiber from the optically anisotropic carbonaceous pitch produced in accordance with the invention, and the features and advantages of the manufacturing process will be described below.

For the spinning, any of the methods currently in use may be employed. For example, the material pitch is charged into a metal vessel for spinning equipped with a spinneret at the bottom which has holes 0.1 to 0.5 mm in diameter. In an inert gas atmosphere the pitch is kept in a molten state at a constant temperature between 280° and 370° C. As the inert gas pressure is boosted to several hundred millimeters of mercury, the molten pitch is extruded downward through the spinneret. While the temperature and atmosphere of the downflow region are being controlled, the pitch filaments are taken up on a bobbin running at a high speed or are towed and collected in a box below by dint of a gas stream. Continuous spinning is made possible by feeding the molten pitch to the spinning vessel under pressure by a gear pump or the like. It is further possible to take up the pitch filaments while drawing them with jets of gas kept at a predetermined temperature and directed downward at a high speed from around the spinneret to form long or short staples or a matlike nonwoven fabric of interlocked pitch-fiber staples on a belt conveyor below.

Another possible alternative is a method which comprises rotating a cylindrical spinning vessel equipped with spinnerets along the peripheral wall at a high speed, feeding molten pitch continuously to the vessel, and collecting the pitch filaments being centrifugally extruded through the peripheral wall of the cylindrical spinner and drawn by the rotating action.

In any case the use of a pitch according to the invention is characterized in that the temperature suitable for the spinning of the pitch in a molten state is in the range of 280° to 370° C., or lower than the usually used range, in spite of the unusually high AP content of 95% or upward. The low temperature minimizes the thermal decomposition and polymerization during the spinning process, with the advantageous consequence that the resulting pitch fiber has practically the same chemical composition as that of the pitch before spinning.

Even at such a low spinning temperature, the pitch of the invention actually behaves like an almost or completely homogeneous single-phase substance. Consequently, it offers the advantages of being smoothly spun and drawn with negligible frequency of end breakage, yielding filaments of a substantially constant diameter under a set of predetermined conditions. Thus, a pitch fiber usually having a diameter of 7 to 15 μm is obtained.

With a conventional optically anisotropic pitch having an AP content of over 90%, it has been customary to spin the melt kept at a high temperature of 370° to 430° C. This causes considerable thermal decomposition or polymerization, and the resulting pitch fiber often shows a compositional structure at an advanced stage of carbonization as compared with that before spinning.

With the pitch fiber of the invention, by contrast, the pitch composition undergoes little change on spinning. Should any trouble occur during spinning, therefore, the filaments already formed may be remelted for respinning to an economical advantage.

The pitch fiber produced in the foregoing manner from the optically anisotropic carbonaceous pitch in accordance with the invention may be set in an unsaturated polyester resin and polished for microscopic inspection. Under a polarizing microscope the specimen shows that all planes paralel to the fiber axis are optically anisotropic and the oriented layer surfaces are almost parallel to the fiber axis. The minute IP spheres dispersed in the AP phase of the mass of pitch are no longer observed. This is presumably attributed to the fact that the microspheres are drawn to even smaller sizes or IP and AP are dissolved in each other by the shear stresses produced as the pitch passes through the spinneret holes and the resulting filaments are stretched.

The optically anisotropic carbonaceous pitch fiber of the invention can be made into a carbon fiber having high strength and elastic modulus by oxidizing and insolubilizing the fiber in an oxidizing atmosphere and then heating it in an inert atmosphere up to at least 1000° C. Heating to an even higher temperature of at least 2000° C. will convert it to a graphite fiber which possesses great strength and yet very high elastic modulus.

For the step of oxidizing the pitch fiber to obtain an infusible carbonaceous fiber, there exist varied combinations of temperature, oxidizing agent, and reaction time that may be used.

Although any known method may be utilized, the oxidation reaction is carried out at a temperature lower than with known optically anisotropic pitch fibers, since the lower softening point is a feature that characterizes the pitch of the invention. The pitch fiber will otherwise partially fuse or crimp, failing to yield a satisfactory end product. A reasonable process involves a short-time treatment at a temperature of 200° C. or downward in an atmosphere containing an oxidizing agent such as a halogen, $NO_2$, or ozone. An easier and more dependable process comprises holding the pitch fiber in an oxygen gas atmosphere first at a temperature 30° to 50° C. lower than the softening point of the particular pitch, or usually between 200° and 240° C., for 10 minutes to 2 hours depending on the temperature used until an adequate insolubility is attained, and then, if necessary, boosting the temperature to about 300° C. to conclude the infusibilizing treatment. Where an oxidizing agent is not specifically used, it is alternatively possible to leave the pitch fiber standing for many hours in air at 150° to 250° C. depending on the softening point of the pitch, and then raising the temperature within a short period to the range of 300° to 350° C. Of the pitches according to the invention, those having softening points above 280° C. are more preferred because they can be infusibilized by maintaining in air for about 30 minutes to 2 hours using a temperature of 230° to 250° C.

Next, the infusibilized optically anisotropic carbonaceous pitch fiber of the invention is carbonized by heating to a temperature between 1000° and 2000° C. either in vacuum or in a chemically inert gas atmosphere of argon, highly pure nitrogen or the like. In this way a carbon fiber having high strength and high elastic modulus is obtained. When the temperature is further boosted to a higher range of 2000° to 3000° C. for a further graphitizing reaction, a graphite fiber results.

In the present invention the carbonization and graphitization are not limited to particular methods but any known method is employable. Whatever the method employed, the use of an optically anisotropic carbonaceous pitch prepared in accordance with the invention as the starting material presents an advantage that the temperature increases from room to the final carbonization temperature at an adequately high rate with a substantially constant gradient, eliminating the need of any residence at the final carbonization temperature. Immediately after the arrival at the final temperature the product can be cooled rapidly.

This permits simplification of the carbonizing furnace structure and facilitates the carbonization process.

It will be understood from the foregoing description that the optically anisotropic carbonaceous pitch produced under the invention combines a highly oriented molecular arrangement with a sufficiently low softening point and substantial homogeneity for spinning and forming, all suited for the manufacture of high-performance carbon or graphite fiber. It should also be clear that the optically anisotropic carbonaceous pitch of the invention described above can be most efficiently produced by the specific controlled process.

The optically anisotropic pitch produced by the process of the invention has a very low softening point (320° C. or below) despite the fact that it is a substantially homogeneous pitch containing 95% or more AP. It can therefore be spun at a reasonably low melt-spinning temperature (380° C. or downward, usually between 280° and 370° C.), and a pitch of quality with properties within given desirable ranges can be easily made under control. These, in turn, produce the following advantageous effects.

Since the pitch can be spun at a temperature sufficiently below the level at which thermal cracking and polycondensation take place appreciably and substantially constant throughout the spinning, and also because it behaves as a homogeneous pitch, the pitch spinnability (resistance to breaking, fineness of filament, and uniformity of diameter) is good and stable, and the productivity of the spinning process is improved.

Moreover, the quality of the product carbon fiber is stable because the pitch undergoes no qualitative change during spinning. Quite negligible decomposition gas generation and infusibles formation during spinning leads to accordingly little defects (bubbles or solid impurity particles) in the resulting pitch fiber, with a corresponding increase in the strength of the product carbon fiber. In addition, because the carbonaceous pitch of the invention practically entirely takes the form of liquid crystals with excellent molecular orientation, the carbon fiber made by spinning the pitch, has a graphite structure with orientation well developed in the direction of the fiber axis and the microstructure content of poor orientation is low. Hence, the fiber exhibits high modulus of elasticity as well as high strength. The structure of the cross section normal to the fiber axis of the carbon fiber thus produced is dense, and the fibril orientation is limited crosswise and does not take a distinctly concentric circular or radial form, and therefore the fiber is free of crack axially. With these and other advantages the pitch fiber of the invention gives carbon or graphite fiber of excellent quality.

This invention is illustrated by the following examples which are, of course, in no way limiting.

EXAMPLE 1

A carbonaceous pitch containing about 96% optically anisotropic phase (AP) and having a softening point of 256° C. was used as a precursor pitch.

The pitch contained 37 wt% quinoline-insoluble matter and 0.110 wt% ash and, in molten state at 320°, 350°, and 380° C., exhibited viscosities of 160, 20, and 4.8 poises, respectively.

It was melted in a melting tank having a capacity of 20 l, the temperature was controlled at 360° C., and was fed at a predetermined flow rate of 20 ml/min into a cylindrical continuous centrifuge having an effective rotor capacity of 200 ml. While the rotor temperature was being controlled at a predetermined level, the pitch flowing out of the liquid phase outlet was continuously sampled.

The rotor temperature was varied to 320°, 350°, and 380° C. and the centrifugal force to 10,000 and 30,000 G. Under each set of the conditions about one kilogram of pitch was obtained through the centrifuge. At 320° C. the viscosity was so high that the pitch frequently choked the inlet or outlet of the continuous centrifugal equipment.

The pitches obtained under these conditions all did not show significant differences in softening point, quinoline-insoluble content, and optically anisotropic phase (%) from the precursor pitch, but changes in ash content were observed.

Each of the pitches obtained under the foregoing conditions and the precursor pitch as a control was charged into a spinner equipped with a nozzle having a hole diameter of 0.3 mm. The charge was melted at 340° C., and the melt was extruded through the nozzle under a nitrogen pressure of about 100 mmHg, the filaments were wound on a bobbin running at a high speed beneath the nozzle, and were spun at a take-up rate of 500 m/min. During this, the frequency of breaking was examined. Each pitch fiber obtained was infusibilized by standing in an oxygen atmosphere at 200° C. for one hour and then at 230° C. for the same period. Next, the fiber was gradually heated in $N_2$ gas at a rate of 25° C. per minute up to 1500° C., and then allowed to cool so as to obtain a carbon fiber.

Part of each carbon fiber was furher heated in an argon stream at a rate of increase of 50° C./min to 1100° C. and at 100° C./min from 1100° C. up to 2400° C. The resultant afforded a graphite fiber on cooling. Table 1 shows the ash contents and spinnabilities of the optically anisotropic pitches obtained under the above-mentioned centrifuging conditions, and the physical properties of the carbon and graphite fibers (tensile strengths and moduli of elasticity of the monofilaments).

TABLE 1

| Centrifuging condition | | Pitch properties | | | Spinnability | Carbon fiber physical properties | | | Graphite fiber physical properties | | |
|---|---|---|---|---|---|---|---|---|---|---|---|
| Rotor temp. °C. | Centrifugal force, G | AP % | Sf. pt °C. | Ash cont. wt % | Freq. of breaking time/10 min | Av. dia. μm | Str. GPa | Elas. mod. GPa | Av. dia. μm | Str. GPa | Elas. mod. GPa |
| 320 | 10,000 | 96 | 258 | 0.059 | 3 | 8.2 | 1.9 | 200 | 8.0 | 1.8 | 430 |
| 320 | 30,000 | 94 | 253 | 0.028 | 1 or less | 8.5 | 2.5 | 180 | 8.1 | 1.9 | 450 |
| 350 | 10,000 | 96 | 252 | 0.014 | 1 or less | 8.2 | 2.9 | 220 | 7.7 | 2.2 | 440 |
| 350 | 30,000 | 96 | 255 | 0.005 | 1 or less | 8.4 | 3.4 | 210 | 8.0 | 3.0 | 460 |
| 380 | 10,000 | 98 | 262 | 0.007 | 1 or less | 8.8 | 3.3 | 230 | 8.5 | 2.7 | 440 |
| 380 | 30,000 | 98 | 260 | 0.007 | 1 or less | 8.5 | 3.2 | 200 | 8.1 | 2.8 | 420 |
| Control: a precursor pitch | | 96 | 256 | 0.110 | 7 | 8.6 | 1.9 | 190 | 8.3 | 1.4 | 420 |

EXAMPLE 2

A carbonaceous pitch containing about 55% optically anisotropic phase (AP) and having a softening point of 232° C. was used as a precursor pitch. This precursory pitch contained 16.1 wt% quinoline-insoluble matter and 0.26 wt% ash, and exhibited a viscosity of 2.8 poises at 370° C. The pitch was melted in a melting tank having a capacity of 20 l, the temperature was controlled to be 370° C., and was fed at a flow rate of 20 ml per minute to a cylindrical continuous centrifuge having an effective rotor capacity of 200 ml. While the rotor temperature was being controlled at 370° C., the centrifugal force of either 10,000 or 30,000 G was applied. In each run, a pitch portion having a large proportion of the optically anisotropic phase (pitch A) was continuously extracted through an AP outlet, and a pitch portion high in the optically isotropic phase (pitch I) through an IP outlet. For the extraction of the AP portion, the centrifuge was constructed so that the portion could be taken out not from the bottom of the AP region but from a point close to the upper layer of AP. The structure allowed solid particles of heavier specific gravities to remain deposited on the rotor walls.

Under the different sets of centrifuging conditions about one liter each of the precursor pitch was subjected to the continuous centrifuging to obtain pitches A and I.

Under the centrifuging conditions within the ranges specified above, either pitches A or I of substantially the same properties were obtained in about the same yields. In the case of pitches A, the yield was about 54%, the softening point was about 265° C., the quinoline-insoluble content was 29.4 to 29.6 wt%, and the optically anisotropic phase content was always about 98%. With pitches I, the yield was about 46%, the softening point was about 224° C., the quinoline-insoluble content was 0.7 to 2.5 wt%, and optically anisotropic phase content was 1 to 2%.

As for the ash contents in pitches A, Table 2 indicates that the greater the centrifugal force exerted the less will be the ash content.

Each of the pitches A obtained under the different centrifugal force conditions was charged into a spinner equipped with a nozzle with a hole diameter of 0.3 mm, melted at 355° C., and the melt was extruded through the nozzle at a nitrogen pressure of about 200 mmHg. The resulting filaments were wound on a bobbin running at a high speed under the nozzle and were spun at a take-up speed of about 500 m/min. The frequency of breaking during this spinning process was recorded. The pitch fibers spun in this way were infusibilized, carbonized, and graphitized by the same method and under the same conditions as used in Example 1. The physical properties of the monofilaments of the carbon and graphite fibers so obtained were determined.

The results are given in Table 2.

TABLE 2

| Centrifuging condition | | Pitch A properties | | | Spin-nability | Carbon fiber physical properties | | | Graphite fiber physical properties | | |
|---|---|---|---|---|---|---|---|---|---|---|---|
| Rotor temp. °C. | Centri-fugal force, G | AP % | Sf. pt °C. | Ash cont. wt % | Freq. of breaking time/10 min | Av. dia. μm | Str. GPa | Elas. mod. GPa | Av. dia. μm | Str. GPa | Elas. mod. GPa |
| 370 | 10,000 | 98 | 264 | 0.011 | 1 or less | 8.5 | 3.3 | 210 | 7.9 | 2.6 | 430 |
| 370 | 30,000 | 98 | 265 | 0.007 | " | 8.5 | 3.1 | 220 | 8.2 | 2.6 | 420 |

After the series of continuous centrifuging runs, the feeding and rotation were stopped, and the pitch retained inside the rotor was taken out from the bottom. It was analyzed to contain 19.4% quinoline-insolubles and 2.9 wt% ash.

EXAMPLE 3

Pitch I obtained with the centrifugal force of 10,000 G in Example 2 was found on analysis to have a quinoline-insoluble content of 1.5 wt%, softening point of 223° C., and optically anisotropic phase content of aobut 2%. Its ash content was not more than 0.001%. In a 500-ml reaction vessel of stainless steel, 200 g of this pitch was heat-treated at 430° C. for 2.5 hours, with the passage of nitrogen gas at a flow rate of 2 l/min. The treatment yielded 172 g of a carbonaceous pitch having a softening point of 292° C., optical anisotropic phase content of 95% or more, and quinoline-insoluble content of 35 wt%.

This carbonaceous pitch was spun by the same procedure as used in Example 1 (except that the spinning temperature was increased to 375° C.) and was infusibilized, carbonized, and graphitized to obtain carbon and graphite fibers. Tests on the properties showed that the carbon fiber had a fiber diameter of 7.2 μm, tensile strength of 3.5 GPa, and tensile modulus of elasticity of 240 GPa. The graphite fiber gave values of 7.0 μm, 2.7 GPa, and 410 GPa, respectively.

EXAMPLE 4

One hundred grams of pitch I obtained with the centrifugal force of 10,000 G in Example 2 was ground to 100 mesh or finer size and about 5 l of toluene was added. The mixture was kept at 80° C. and slowly agitated for 15 hours. Then, a toluene-insoluble matter was removed by filtration, and the solution was vacuum dried at a room temperature to obtain 45 g of powdery pitch.

This powdery pitch had a softening point of 315° C. and contained 12.1 wt% quinoline-insolubles. When solidified after melting, it contained about 94% optically anisotropic phase. In the same way as in Example 1 this pitch was spun (except that the spinning temperature was 390° C. and the pressure was 400 mmHg), infusibilized, carbonized, and graphitized to obtain carbon and graphite fibers. The tensile physical properties of their monofilaments were determined. The fiber diameter, tensile strength, and tensile modulus of elasticity were for the carbon fiber 7.7 μm, 3.2 GPa, and 220 GPa, respectively, and for the graphite fiber 7.3 μm, 2.8 GPa, and 540 GPa.

INDUSTRIAL APPLICABILITY

As described in detail above, it is possible in accordance with the invention to manufacture carbon and graphite fibers light in weight and high in strength and modulus of elasticity. Such carbon and graphite fibers have applications in various sectors of industry, including automobile, aircraft, and other diversified technological fields.

What is claimed is:

1. In a process for manufacturing a carbon fiber or graphite fiber by melt-spinning a carbonaceous pitch, infusibilizing the resulting pitch fiber, carbonizing, or carbonizing and graphitizing, the fiber, the improvement comprises: centrifuging a molten precursor of said carbonaceous pitch at a temperature ranging from about 280° C. to about 400° C. and at a centrifugal acceleration of at least 10,000 G or more, said precursor comprising an optically anisotropic phase and an optically isotropic phase and a solid slurry and said precursor having a viscosity of 100 poises or less; thereby simultaneously separating said precursor into three layers, said three layers being a solid slurry layer and an optically anisotropic phase layer and an optically isotropic phase layer; and thereafter employing the optically anisotropic phase layer as said carbonaceous pitch.

2. A process according to claim 1 wherein said precursor is obtained by thermal cracking and polycondensation of a pitch material prepared by removing the hydrocarbon fraction which boils below 400° C. from a catalytic cracking residue.

3. A process according to claim 1 wherein the centrifuging temperature ranges from about 320° C. to about 380° C. and the viscosity of the pitch is 50 poises or less.

4. A process according to claim 1 or 2 wherein said precursor further comprises about 10% or more of said optically anisotropic phase and has a softening point temperature of about 280° C. or less.

5. A process according to claim 4 wherein said precursor comprises about 20% to about 70% of said optically anisotropic phase and has a softening point of about 150° C. to about 280° C.

6. A process according to claim 4 wherein, said precursor comprises about 10% or more of said optically anisotropic phase and has a softening point of about 150° C. to about 280° C., the resulting optically isotropic phase layer is after-treated.

7. A process according to claim 6 wherein said after-treating is heat treating at a temperature in the range of about 350° C. to about 600° C.

8. A process according to claim 6 wherein said after-treating is a solvent extraction treating for the removal of low-molecular-weight pitch ingredients.

* * * * *